US005707176A

United States Patent [19]

Okubo

[11] Patent Number: 5,707,176

[45] Date of Patent: Jan. 13, 1998

[54] EARTH DISCHARGE CONTROL SYSTEM FOR SMALL-DIAMETER PIPE PROPELLING MACHINE

[75] Inventor: Yasuo Okubo, Osaka, Japan

[73] Assignee: Kabushiki Kaisha Komatsu Seisakusho, Tokyo, Japan

[21] Appl. No.: 582,999

[22] PCT Filed: May 6, 1994

[86] PCT No.: PCT/JP94/00740

§ 371 Date: Dec. 1, 1995

§ 102(e) Date: Dec. 1, 1995

[87] PCT Pub. No.: WO94/27028

PCT Pub. Date: Nov. 24, 1994

[30] Foreign Application Priority Data

May 14, 1993 [JP] Japan ..... 5-135205

[51] Int. Cl.[6] ..... E21D 9/00

[52] U.S. Cl. ..... 405/184; 405/138; 175/171

[58] Field of Search ..... 405/184, 138, 405/143, 140, 141; 175/171

[56] References Cited

U.S. PATENT DOCUMENTS

| | | | |
|---|---|---|---|
| 3,917,010 | 11/1975 | Fink | 175/171 X |
| 4,487,525 | 12/1984 | Shiotsubo et al. | 405/184 |
| 4,506,931 | 3/1985 | Haspert | 175/171 |
| 4,711,310 | 12/1987 | Luen | 175/171 |
| 5,104,263 | 4/1992 | Shibahara et al. | 405/184 |
| 5,478,170 | 12/1995 | Hanamoto et al. | 405/184 X |

FOREIGN PATENT DOCUMENTS

| | | | |
|---|---|---|---|
| 62-11160 | 3/1987 | Japan . | |
| 4-001398 | 1/1992 | Japan | 405/184 |
| 4-65893 | 6/1992 | Japan . | |
| 5-133192 | 5/1993 | Japan | 405/184 |

*Primary Examiner*—Tamara L. Graysay
*Assistant Examiner*—Frederick L. Lagman
*Attorney, Agent, or Firm*—Flynn, Thiel, Boutell & Tanis, P.C.

[57] ABSTRACT

An earth discharge control system for a small-diameter pipe propelling machine controls the excavated earth discharging operation of the small-diameter pipe propelling machine. The small-pipe propelling machine propels a small-diameter pipe (2) joined at its leading end to a leading pipe (1) into the ground by a propelling unit (3) installed in a starting shaft (4). Earth excavated by a cutting head (8) supported on the leading end of the leading pipe (1) is conveyed toward the starting shaft (4) by a screw conveyor (6) disposed within the small-diameter pipe (1). A pneumatically operated control valve (10) is disposed in combination with a portion of the screw conveyor (6) within the leading pipe (1). A pressure detector (23) detects the pressure in the pressure chamber (10*a*) of the control valve (10) and the amount of excavated earth contained in a portion of a casing (6*b*) extending ahead of the control valve (10) is estimated on the basis of the pressure in the pressure chamber (10*a*) of the control valve (10). The rotation of the screw shaft (6*a*) of the screw conveyor (6) is controlled on the basis of information thus acquired so that an optimum amount of excavated earth is taken always into the screw conveyor (6).

8 Claims, 10 Drawing Sheets

EARTH DISCHARGE CONTROL SYSTEM FOR SMALL-DIAMETER PIPE PROPELLING MACHINE

TECHNICAL FIELD

The present invention relates to an earth discharge control system for a small-diameter pipe propelling machine for laying a small-diameter pipe in the ground.

BACKGROUND ART

A conventional small-pipe propelling machine for laying a small-diameter pipe in the ground has a propelling unit disposed in a starting shaft which propels a small-diameter pipe provided at its leading end with a leading pipe in the ground to lay the small-diameter pipe underground.

A cutter head is attached to the leading end of the leading pipe, and earth excavated by the cutter head is conveyed into the starting shaft by a screw conveyor. The screw conveyor is provided at a portion in the leading pipe with a control valve, the control valve is regulated to adjust its opening according to the rate of discharge of excavated earth into the starting shaft to regulate the earth discharging rate.

When the control valve is regulated according to the rate of discharge of excavated earth into the starting shaft, the excavating efficiency of the cutting head is reduced due to excessively small excavation resulting from the abrupt change in the properties of earth, because changes in the excavating condition in the leading pipe appears in the starting shaft with a delay.

The present invention has been made in view of the aforesaid disadvantage and it is therefore an object of the present invention to provide an earth discharge control system for a small-diameter pipe propelling machine, capable of controlling the discharge of excavated earth so that excavated earth is discharged at an optimum earth discharge rate at all times.

DISCLOSURE OF THE INVENTION

With the foregoing object in view, the present invention provides an earth discharge control system for a small-diameter pipe propelling machine comprising a propelling unit installed in a starting shaft and capable of propelling a small-diameter pipe provided at its leading end with a cutting head under the ground, and a screw conveyor extended in the small-diameter pipe to convey earth excavated by the cutting head into the starting shaft, comprising a pneumatically operated control valve disposed in combination with a portion of the screw conveyor within the leading pipe, and a pressure detector for detecting the amount of excavated earth contained in a portion of a casing extending ahead of the control valve through the detection of the pressure in the pressure chamber of the control valve and to control the rotation of the screw shaft of the screw conveyor on the basis of information acquired by the pressure detector.

The earth discharge control system controls the rotating speed of the screw shaft of the screw conveyor so that a fixed amount of excavated earth is contained always in the portion of the casing extending ahead of the control valve and, consequently, troubles due to conveyance of excavated earth at an excessively high or low rate can be prevented.

BEST MODE FOR CARRYING OUT THE INVENTION

An earth discharge control system for a small-diameter pipe propelling machine, in a preferred embodiment according to the present invention will be described hereinafter with reference to the accompanying drawings.

Figure 1:
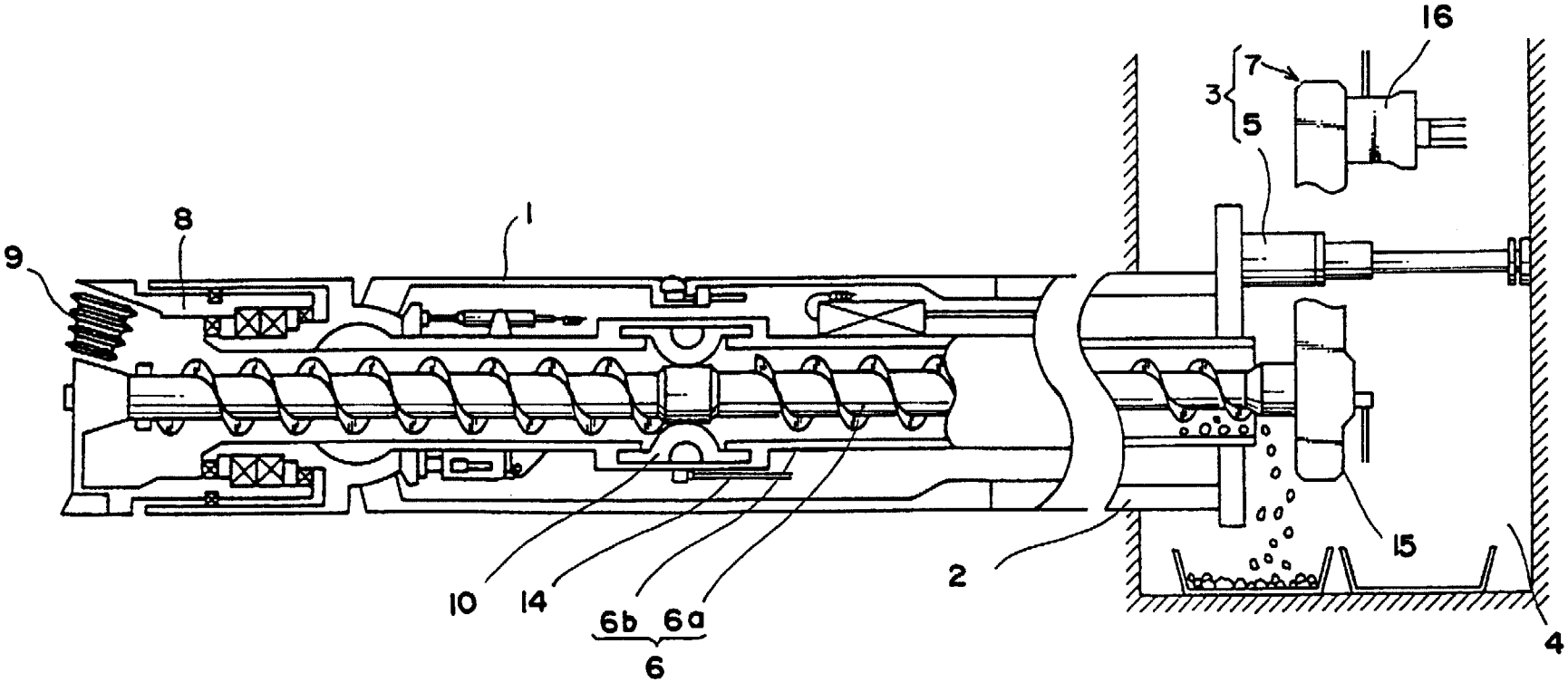
FIG. 1 is a partly sectional front view of a small-diameter pipe propelling machine incorporating an earth discharge control system in a first embodiment according to the present invention.

Referring to FIG. 1 showing a small-diameter pipe propelling machine, there are shown a small-diameter pipe 2, a leading pipe 1 joined, to the leading end, the front end, of the small-diameter pipe 2, and a propelling unit 3 installed in a starting shaft 4. The propelling unit 3 comprises a propelling jack 5 for propelling the small-diameter pipe 2 into the ground, and a drive unit 7 for driving the screw shaft **6*a* of a screw conveyor 6 extended in the small-diameter pipe 2 for rotation. A cutting head 8 is supported for rotation on the leading end of the leading pipe 1. The cutting head 8 is coupled with the extremity of the screw shaft 6*a* of the screw conveyor 6 and is driven for rotation through the screw shaft 6*a* by the drive unit 7. A disk cutter 9 rotatably supported on the front end of the cutting head 8** excavates the facing.

Excavated earth is taken into the leading pipe 1 and is conveyed backward through a casing **6*b* into the starting shaft 4 by the screw conveyor 6. A control valve 10 for regulating earth discharge rate is disposed in the leading pipe 1 in combination with the screw conveyor 6**.

Figure 2:
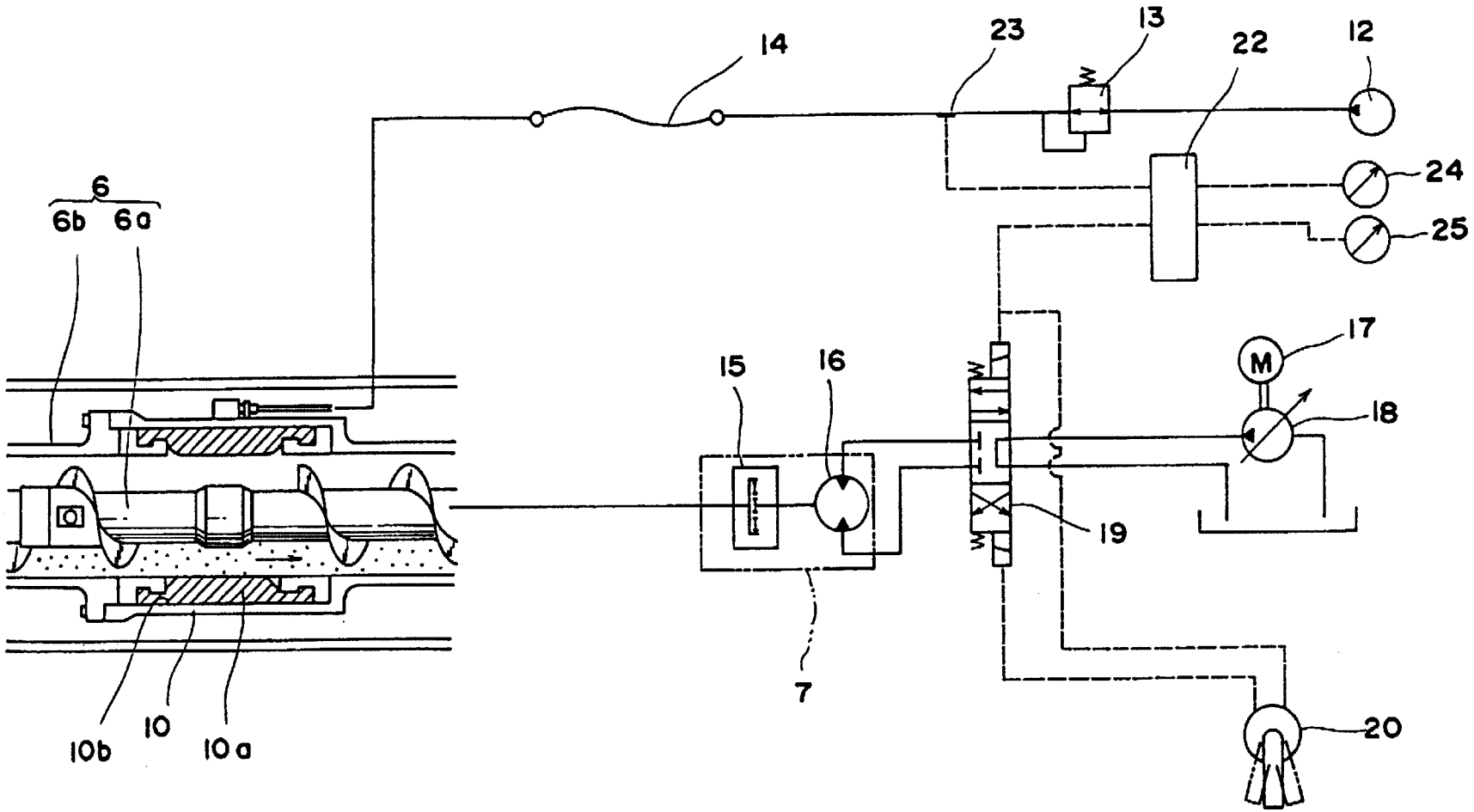
FIG. 2 is a diagrammatic view of assistance in explaining the operation of the earth moving device of the small-diameter pipe propelling machine of FIG. 1.

As shown in FIG. 2, the control valve 10 has a tubular valve element **10*a* formed of an elastic material, such as rubber, capable of being expanded by air and of contracting. Air supplied by an air source 12 and having a pressure regulated by a pressure regulating valve 13 is supplied through an air supply line 14 into a pressure chamber 10b surrounding the valve element 10a**.

The drive unit 7 for driving the screw shaft 6a of the screw conveyor 6 is provided with a hydraulic motor 16 connected through a reduction gear 15 to the screw shaft 6a. A working fluid is supplied through an operating valve 19, i.e., a solenoid valve, to the hydraulic motor 16 by a hydraulic pump 18 driven by an electric motor 17.

A signal provided by the solenoid of the operating valve 19 is given to a computer 22. The computer 22 receives an electric signal representing the pressure in the pressure chamber 10b detected by a pressure detector 23 disposed on the air supply line 14. A pressure indicator 24 for indicating the pressure P in the air supply line 14, and a pressure difference indicator 25 for indicating the pressure difference P between pressure during the continuation of operation of the screw conveyor 6 and pressure during the stoppage of operation of the screw conveyor 6.

The operation of the earth discharge control system will be described with reference to FIGS. 3 to 8.

Figure 3:
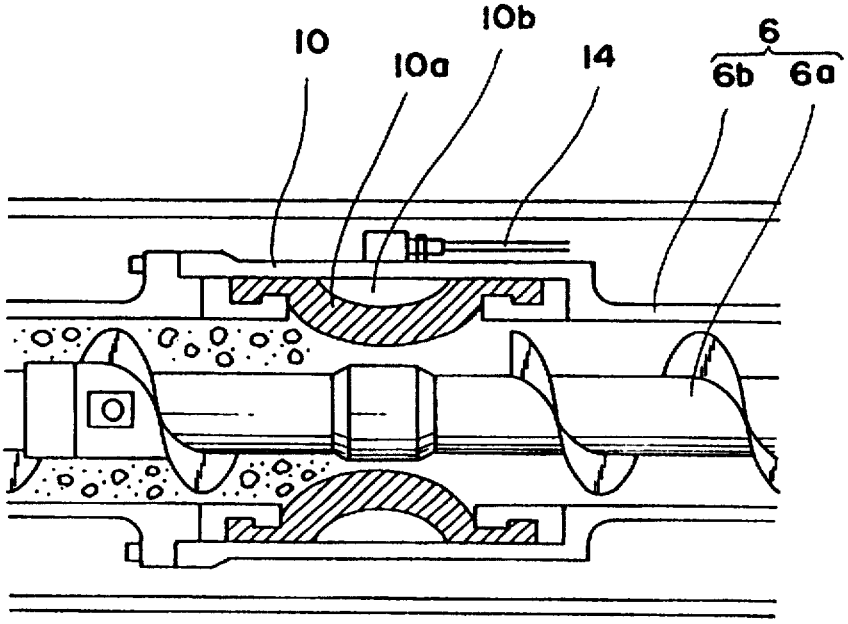
FIG. 3 is a fragmentary longitudinal sectional view of assistance in explaining the operation of the earth moving device of the small-diameter pipe propelling machine of FIG. 1.
Figure 6:
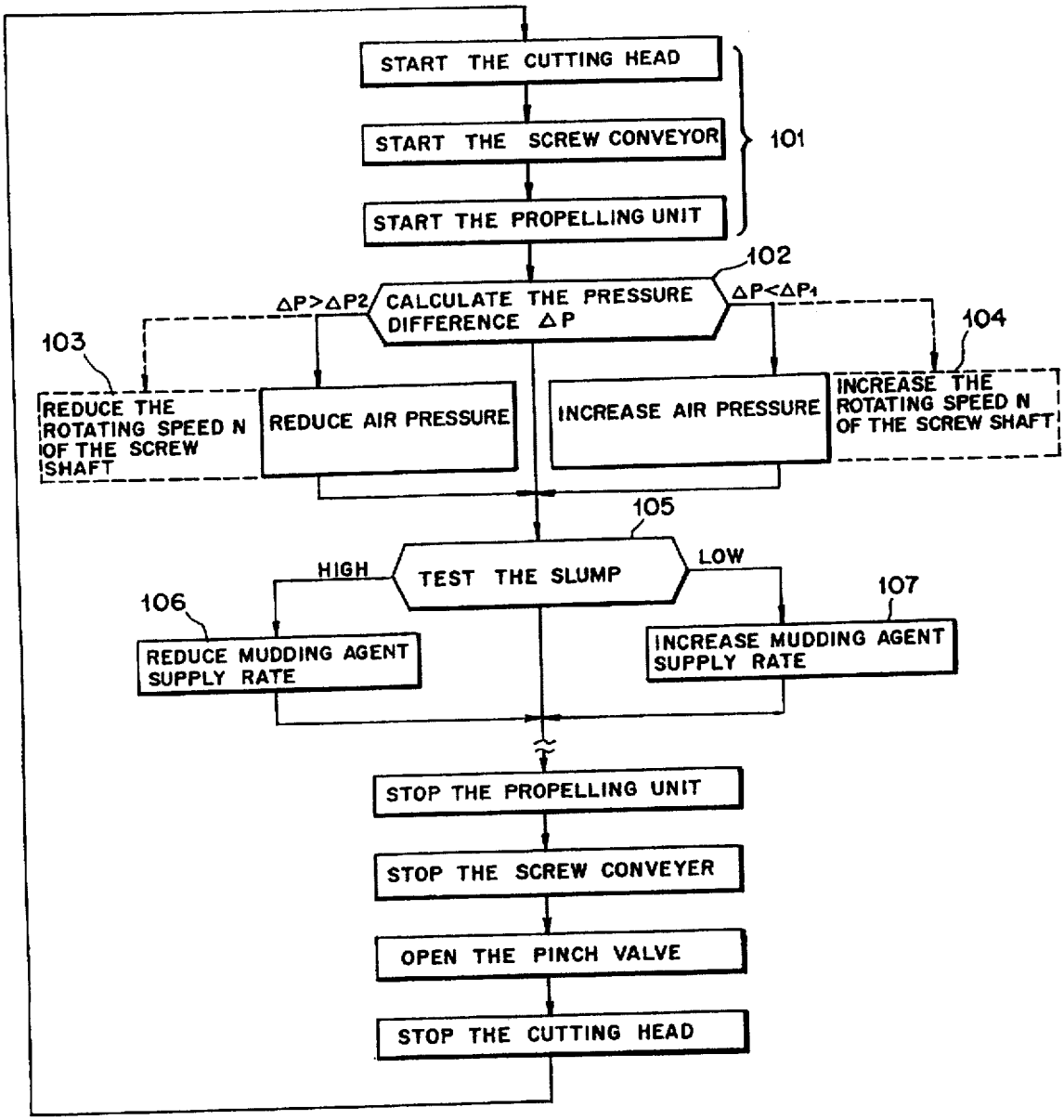
FIG. 6 is a flow chart of an operation to be carried out by the earth moving device of the small-diameter pipe propelling machine of FIG. 1.
Figure 7:
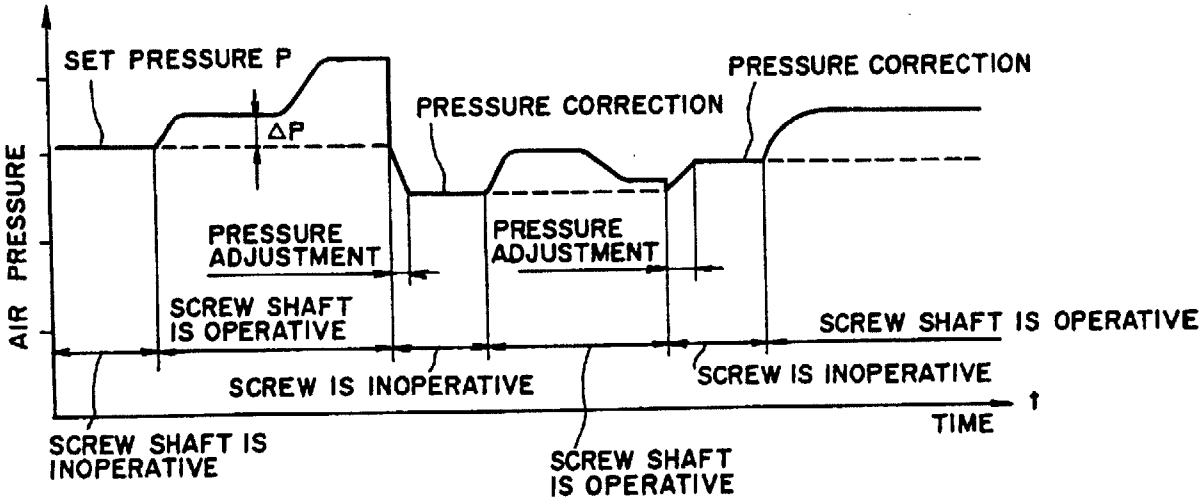
FIG. 7 is a diagram of assistance in explaining the operation of the earth moving device of the small-diameter pipe propelling machine of FIG. 1.

Referring to FIG. 6, in step 101, the drive unit 7 drives the screw shaft 6a of the screw conveyor 6 and the cutting head 8 for rotation, and the propelling device 3 installed in the starting shaft 4 propels the small-diameter pipe 2 into the ground. Air of a set pressure P regulated by the pressure regulating valve 13 is supplied into the pressure chamber 10b of the control valve 10 to expand the valve element 10a as shown in FIG. 3, and the casing 6b is filled up with excavated earth. After the casing 6b has been filled up with excavated earth, excavated earth filling up the casing 6b makes an effort to move backward forcing the valve element 10a to open and, consequently, the pressure in the pressure chamber 10b increases. The pressure detector 23 detects the increase in the pressure in the pressure chamber 10b and gives a signal indicating the increase in the pressure to the computer 22, the computer 22 calculates the pressure difference ΔP between the set pressure P and the increased pressure in step 102. The amount of excavated earth filling up the casing 6b is estimated from the pressure difference ΔP.

Figure 4:
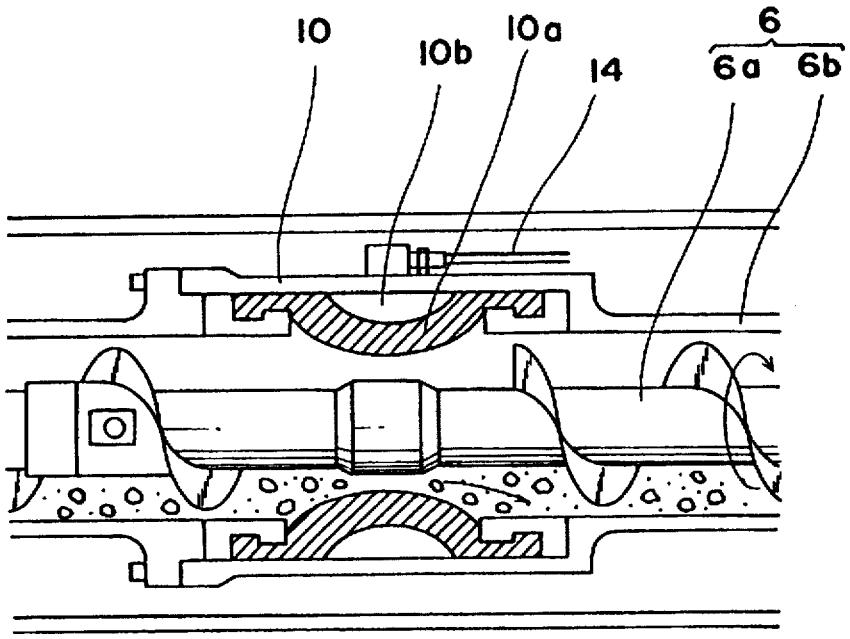
FIG. 4 is a fragmentary longitudinal sectional view of assistance in explaining the operation of the earth moving device of the small-diameter pipe propelling machine of FIG. 1.
Figure 5:
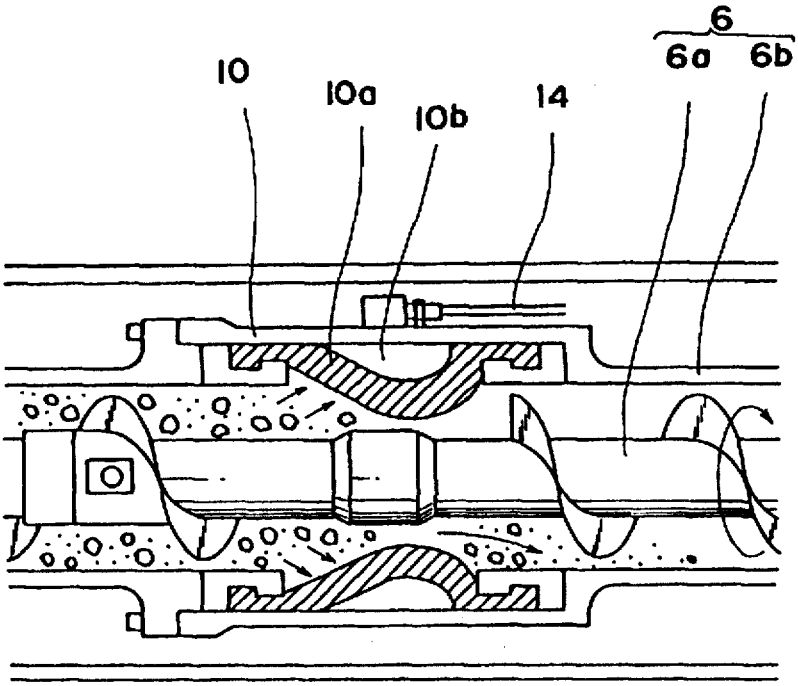
FIG. 5 is a fragmentary longitudinal sectional view of assistance in explaining the operation of the earth moving device of the small-diameter pipe propelling machine of FIG. 1.

The rotation of the screw shaft 6a of the screw conveyor 6 is controlled according to the properties of earth including the grading of earth and sand and water pressure acting on earth so that the pressure in the pressure chamber 10b is maintained in a predetermined control range. When the casing 6b is not filled up with excavated earth as shown in FIG. 4, a comparatively small external pressure acts on the valve element 10a of the control valve 10 and hence the pressure in the pressure chamber 10b is nearly equal to the set pressure P. In this state, the control valve 10 is closed to fill up the casing 6b with excavated earth. When the casing 6b is filled up with excavated earth as shown in FIG. 5, the external pressure acting on the valve element 10a of the control valve 10 increases and, consequently, the pressure in the pressure chamber 10b increases.

Figure 8:
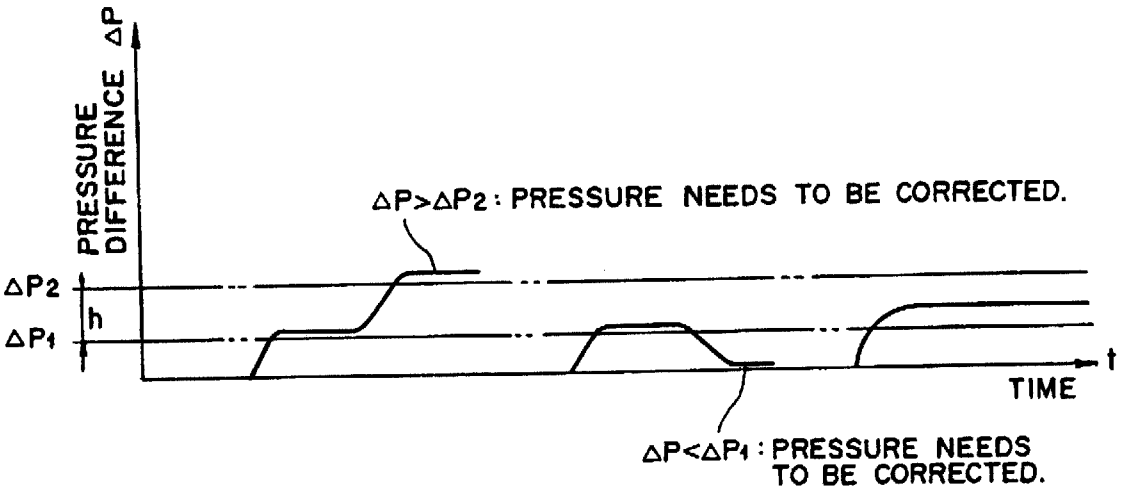
FIG. 8 is a diagram of assistance in explaining the operation of the earth moving device of the small-diameter pipe propelling machine of FIG. 1.

The mode of increase in the pressure in the pressure chamber 10b is dependent on the properties of excavated earth filling up the casing 6b, a control range h is predetermined as shown in FIG. 8, and the rotation of the screw shaft 6a of the screw conveyor 6 is controlled so that the pressure difference ΔP is within the control range h. If the pressure difference ΔP detected in step 102 is greater than the upper control limit $P_2$ of the control range h, the rate of supply of the working fluid to the hydraulic motor 16 of the drive unit 3 is reduced in step 103 to reduce the rotating speed of the screw shaft 6a by controlling the discharge rate of the hydraulic pump 18 by adjusting the inclination of the swash plate of the hydraulic pump 18. If the pressure difference ΔP is smaller than the lower control limit $P_1$, the rotating speed of the screw shaft 6a is increased in step 104. Thus, the operation of the screw conveyor 6 is controlled so that the pressure difference ΔP is always within the control range h. Consequently, the portion of the casing 6b extending ahead of the control valve 10 is always filled up with a fixed amount of excavated earth regardless of the variation of the properties of excavated earth, and neither an excessively large amount of excavated earth nor an excessively small amount of excavated earth is taken into the casing 6b.

When it is difficult to form a plug in the casing 6b due to the properties of excavated earth, the slump of excavated earth is tested in step 105. The supply of a mudding agent is reduced in step 106 when the slump is high or increased in step 107 when the slump is low.

Figure 9:
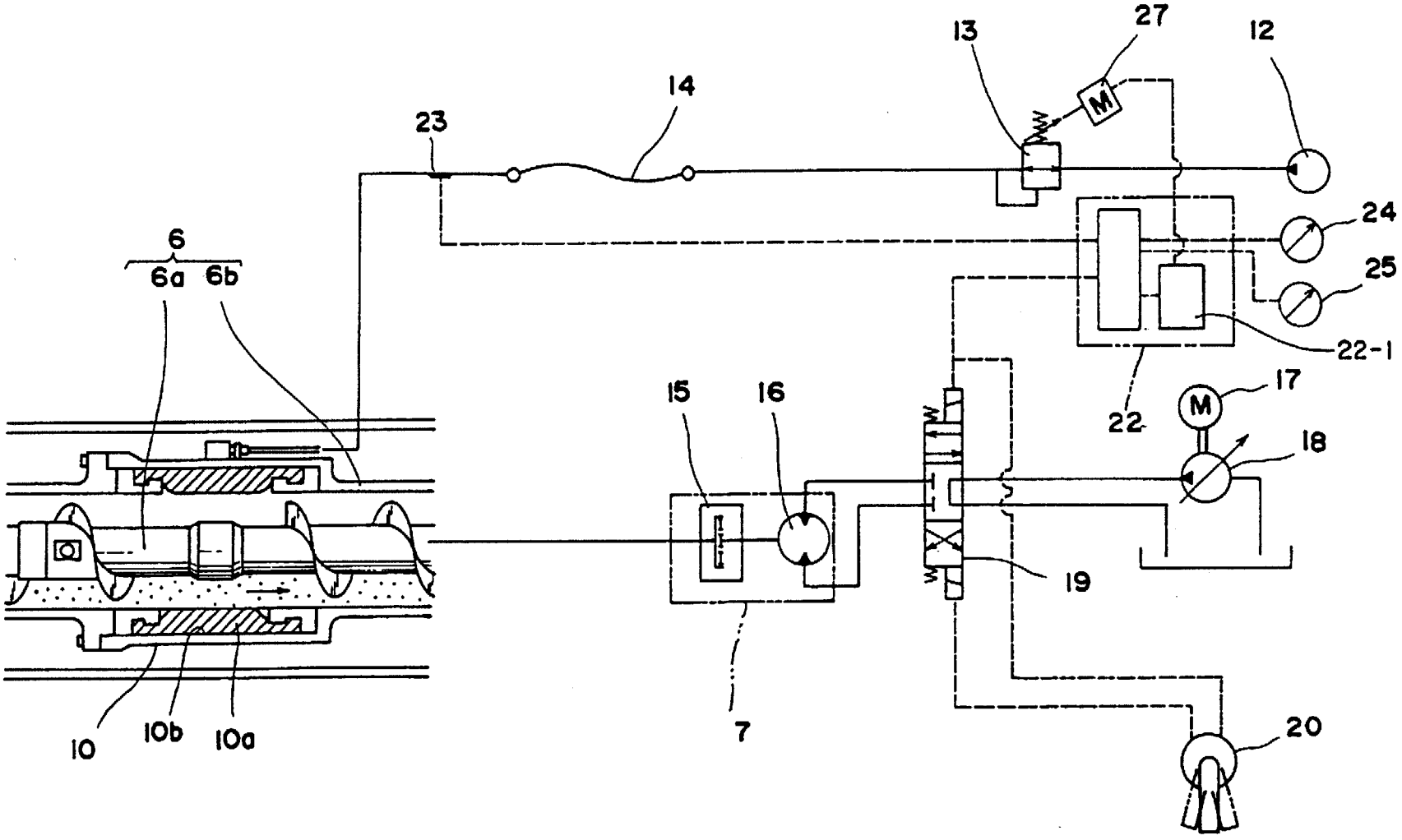
FIG. 9 is a diagrammatic view of an earth discharge control system in a second embodiment according to the present invention incorporated into a small-diameter pipe propelling machine.

When the pressure detector is disposed nearer to the control valve 10 as shown in FIG. 9, the accuracy of detection of the pressure in the air supply line 14 is less subject to a leakage of air from the air supply line 14 and hence accurate control is possible. A servomotor 27 may be connected to the pressure regulating valve 13 to vary the set pressure set for the pressure regulating valve 13 by controlling the servomotor 27 by a controller 22-1.

Figure 10:
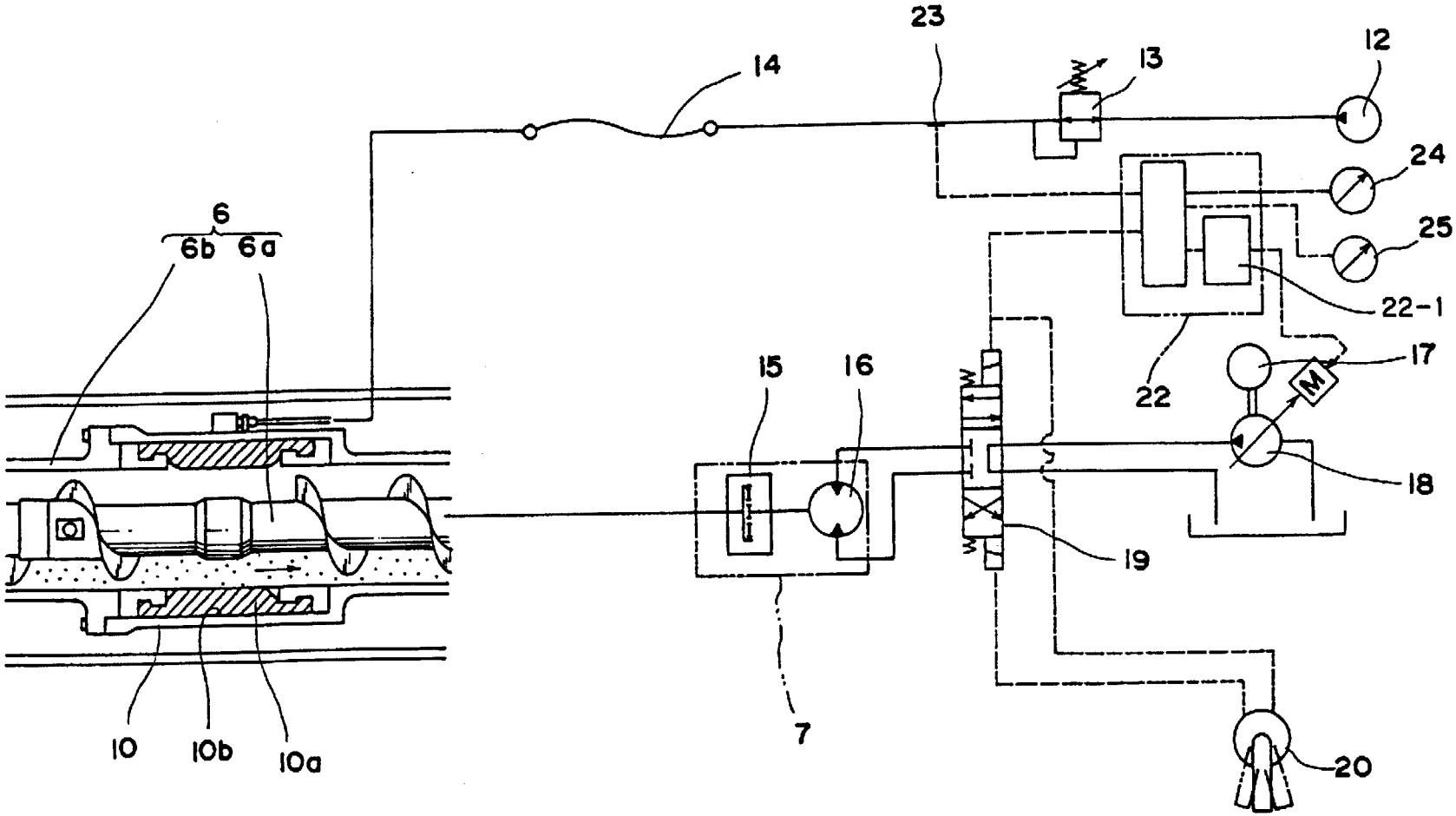
FIG. 10 is a diagrammatic view of an earth discharge control system in a third embodiment according to the present invention incorporated into a small-diameter pipe propelling machine.

As shown in FIG. 10, the discharge of the hydraulic pump 18 may be controlled by the computer 22 to control the rotating speed of the screw shaft 6a of the screw conveyor 6.

CAPABILITY OF EXPLOITATION IN INDUSTRY

As is apparent from the foregoing description, according to the present invention, the pneumatically operated control valve is disposed in combination with the screw conveyor extended within the leading pipe, the amount of excavated earth taken into the portion of the casing extending ahead of the control valve is estimated through the detection of the pressure in the pressure chamber of the control valve, and the rotating speed of the screw shaft of the screw conveyor is regulated so that a fixed amount of excavated earth is contained always in the portion of the casing extending ahead of the control valve. Accordingly, excavated earth is not taken into the portion of the casing extending ahead of the control valve at an excessively high rate or an excessively low rate even if the properties of earth on the facing change during excavation. Consequently, the faulty control of the direction of the leading pipe and land subsidence attributable to earth conveyance at an excessively high rate, and the reduction of the efficiency of excavation attributable to earth conveyance at an excessively low rate can be surely prevented.

Since an earth plug is formed in the portion of the casing extending ahead of the control valve, the squirt of earth and the like can be prevented. Since the amount of earth taken into the portion of the casing extending ahead of the control valve is detected by the control valve, any additional means for detecting the amount of earth is not necessary, which is economically advantageous.

What is claimed is:

1. An earth discharge control system for a pipe propelling machine for positioning a small-diameter pipe in the ground, the small-diameter pipe having a front end, the pipe propelling machine having: a leading pipe positioned against the front end of the small-diameter pipe; a propelling unit positionable in a starting shaft for moving the small-diameter pipe and the leading pipe forward; a screw conveyor disposed in the leading pipe for transporting earth rearwardly towards the starting shaft, said screw conveyor including a rotatably mounted screw shaft and a hydraulic drive unit connected to the screw shaft for rotating the screw shaft, said hydraulic drive unit being configured to rotate the screw shaft at a variable screw shaft speed; and a pneumatically operated control valve located within the leading pipe for regulating rearward movement of earth along the screw conveyor, said control valve including a valve element with an expandable pressure chamber that is inflated to a set pressure and a pressure detector for monitoring the pressure in the pressure chamber, said pressure detector generating a pressure-sensed signal representative of the pressure in the pressure chamber; comprising the improvement wherein said control system comprises:

processor means connected to the pressure detector for receiving the pressure-sensed signal and connected to the hydraulic drive unit for controlling the hydraulic drive unit so as to regulate the screw shaft speed, said processor means being configured to calculate a pressure difference between the set pressure of the pressure chamber and the actual pressure of the pressure chamber as indicated by the pressure-sensed signal and to control the hydraulic drive unit so as to regulate the screw shaft speed based on the calculated pressure difference.

2. The earth discharge control system according to claim 1, further including a pressure regulating valve in communication with the pressure chamber and a servomotor connected to the pressure regulating valve for controlling the state of the pressure regulating valve, and wherein said processor means is connected to said servomotor for controlling said servomotor so as to adjust the set pressure of the pressure chamber.

3. The earth discharge control system according to claim 1, wherein said hydraulic drive unit includes a hydraulic motor which drives the screw shaft and a hydraulic pump which supplies a working fluid to the hydraulic motor, and wherein said processor means is connected to the hydraulic pump for controlling the rate of fluid discharge from the hydraulic pump so as to regulate the speed of the screw shaft to maintain the calculated pressure difference within a set control range.

4. A pipe propelling machine for positioning a small-diameter pipe in the ground, the small-diameter pipe having a front end, the pipe propelling machine comprising: a leading pipe positioned against the front end of the small-diameter pipe, the leading pipe having a front end that is positioned forward of the front end of the small-diameter pipe; a propelling unit for moving the small-diameter pipe and the leading pipe forward; a screw conveyor disposed in the leading pipe for transporting earth rearwardly from the front end of the leading pipe, said screw conveyor including a rotatably mounted screw shaft and a drive unit connected to the screw shaft for rotating the screw shaft, said drive unit being configured to rotate the screw shaft at a variable screw shaft speed; and a pneumatically operated control valve located within the leading pipe, said control valve including a valve element for regulating movement of earth along the screw conveyor, said valve element having an expandable pressure chamber that is inflated to a set pressure; comprising the improvement wherein a control system is provided for regulating the discharge of earth from the leading pipe, said control system including:

a pressure detector in fluid communication with the pressure chamber for monitoring the pressure of the pressure chamber and being configured to generate a pressure-sensed signal representative of the pressure in the pressure chamber; and processor means connected to said pressure detector for receiving the pressure-sensed signal and connected to the drive unit for controlling the drive unit so as to regulate the screw shaft speed, said processor means being configured to calculate a pressure difference between the set pressure of the pressure chamber and the actual pressure of the pressure chamber as indicated by the pressure-sensed signal and to control the drive unit so as to regulate the screw shaft speed based on the calculated pressure difference.

5. The pipe propelling machine according to claim 4, wherein said processor means is configured to compare the calculated pressure difference to a first control value and cause the drive unit to increase the screw shaft speed if the calculated pressure difference is less than the first control value, and to compare the calculated pressure difference to a second control value and cause the drive unit to decrease the screw shaft speed if the calculated pressure difference is greater than the second control value.

6. The pipe propelling machine according to claim 4, including a pressure regulating valve in communication with the pressure chamber and a servomotor connected to the pressure regulating valve for controlling the state of the pressure regulating valve and wherein said processor means is connected to said servomotor for controlling said servomotor so as to adjust the set pressure of the pressure chamber.

7. The pipe propelling machine according to claim 4, wherein said drive unit is a hydraulic drive unit having a hydraulic motor connected to the screw shaft for rotating the screw shaft and a hydraulic pump which supplies a working fluid to the hydraulic motor, and wherein said processor means is connected to said hydraulic pump for controlling the rate of fluid discharge from the hydraulic pump so as to regulate the speed of the screw shaft.

8. The pipe propelling machine according to claim 7, wherein said processor means includes means to compare the calculated pressure difference to a first control value and to adjust the discharge of working fluid from the hydraulic pump so as to cause an increase in the screw shaft speed if the calculated pressure difference is less than the first control value, and to compare the calculated pressure difference to a second control value and to adjust the discharge of working fluid from the hydraulic pump so as to cause a decrease in the screw shaft speed if the calculated pressure difference is greater than the second control value.

* * * * *